US012582236B2

(12) United States Patent
Nuncio

(10) Patent No.: US 12,582,236 B2
(45) Date of Patent: Mar. 24, 2026

(54) VARIABLE TEMPERATURE LAWN CHAIR DEVICE

(71) Applicant: Gregory Nuncio, San Antonio, TX (US)

(72) Inventor: Gregory Nuncio, San Antonio, TX (US)

( * ) Notice: Subject to any disclaimer, the term of this patent is extended or adjusted under 35 U.S.C. 154(b) by 187 days.

(21) Appl. No.: 18/443,523

(22) Filed: Feb. 16, 2024

(65) Prior Publication Data

US 2025/0151914 A1 May 15, 2025

Related U.S. Application Data

(60) Provisional application No. 63/598,709, filed on Nov. 14, 2023.

(51) Int. Cl.
*A47C 7/74* (2006.01)
*A47C 1/14* (2006.01)
*A47C 7/54* (2006.01)

(52) U.S. Cl.
CPC ..... *A47C 7/746* (2013.01); *A47C 1/14* (2013.01); *A47C 7/54* (2013.01); *A47C 7/748* (2013.01)

(58) Field of Classification Search
CPC ..... A47C 7/748; A47C 4/286; A47C 1/14; A47C 4/38; A47C 4/48; A47C 7/622
See application file for complete search history.

(56) References Cited

U.S. PATENT DOCUMENTS 4,141,585 A 2/1979 Blackman
6,000,752 A 12/1999 Shyr
6,848,746 B2 * 2/2005 Gentry ..... A47C 7/748 297/229
7,665,803 B2 2/2010 Wolas
8,870,281 B1 * 10/2014 Boone ..... A47C 7/746 297/180.11
8,979,192 B2 3/2015 Miller
9,549,617 B1 * 1/2017 Deluca ..... A47C 7/746
2010/0032998 A1 * 2/2010 Eckman ..... A47C 7/748 297/217.3
2010/0038938 A1 2/2010 Feinstein
2016/0029805 A1 2/2016 Arens
2016/0076830 A1 * 3/2016 Repp ..... B60N 2/5635 165/287
2021/0153659 A1 * 5/2021 Long ..... A47C 7/748
2022/0232985 A1 * 7/2022 Fulton ..... A47C 7/744
2023/0065151 A1 * 3/2023 Huggins ..... A61F 7/007

* cited by examiner

*Primary Examiner* — Joshua J Michener
*Assistant Examiner* — Cindi M Curry
(74) *Attorney, Agent, or Firm* — Brennan, Manna & Diamond, LLC

(57) ABSTRACT

A variable temperature lawn chair device is disclosed that has the ability to warm or cool its occupant. The variable temperature lawn chair device comprises a body component that comprises a seating area, a backrest, and a plurality of legs. The seating area and backrest comprise a plurality of pockets which house refrigerated or frozen gel packs. The gel packs help keep the user cool without making the chair device uncomfortable to sit on. Further, the device also comprises a battery-powered heating element to provide warmth to the user. Thus, during cold weather, the heating element can be activated to elevate the chair device's temperature and keep the user warm. Accordingly, the chair device's temperature can be regulated to maintain comfort when sitting outdoors.

5 Claims, 3 Drawing Sheets

VARIABLE TEMPERATURE LAWN CHAIR DEVICE

CROSS-REFERENCE TO RELATED APPLICATION

The present application claims priority to, and the benefit of, U.S. Provisional Application No. 63/598,709, which was filed on Nov. 14, 2023, and is incorporated herein by reference in its entirety.

FIELD OF THE INVENTION

The present invention relates generally to the field of variable temperature lawn chair devices. More specifically, the present invention relates to a lawn chair that can be warmed or cooled to maintain comfort when sitting outdoors. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in variable temperature lawn chair devices. Generally, people spending time outdoors may opt to relax in folding lawn chairs. However, sitting outside in warm or cold weather can be uncomfortable. Further, people may have no way to adjust the temperature of their chair and end up frustrated. Additionally, children using chairs may start complaining to their parents about the weather.

People engaging in various outdoor activities such as hunting, fishing, tailgating, or attending sporting events often sit outdoors in portable chairs for prolonged durations. Sitting outdoors during colder months can be extremely uncomfortable; though additional layers of clothing or blankets are sometimes used, they are marginally effective and are cumbersome to transport. Conversely, when a person is seated outdoors during warmer months, little can be done to minimize the discomfort. Accordingly, there is currently a need for a chair having both a cooling and a heating means that can be adjusted according to ambient conditions.

Accordingly, there is a demand for an improved variable temperature lawn chair device that can be warmed or cooled to maintain comfort when sitting outdoors. More particularly, there is a demand for a variable temperature lawn chair device that allows users to regulate the chair's temperature based on weather to maintain optimal comfort.

Therefore, there exists a long-felt need in the art for a variable temperature lawn chair device that provides users with a lawn chair that can be warmed or cooled to maintain comfort when sitting outdoors. There is also a long-felt need in the art for a variable temperature lawn chair device that includes multiple pockets along the backrest and seating area on the chair that can receive refrigerated or frozen gel packs for keeping the user cool. Further, there is a long-felt need in the art for a variable temperature lawn chair device that features an integrated battery-powered heating mechanism to warm the chair during cold weather. Moreover, there is a long-felt need in the art for a device that allows users to regulate the chair's temperature based on weather to maintain optimal comfort while outdoors at campsites, tailgates, sporting events, etc. Further, there is a long-felt need in the art for a variable temperature lawn chair device that utilizes pre-cooled gel packs to cool the chair. Finally, there is a long-felt need in the art for a variable temperature lawn chair device that is available in different colors and sizes.

The subject matter disclosed and claimed herein, in one embodiment thereof, comprises a variable temperature lawn chair device. The device is a portable lawn chair with the ability to warm or cool its occupant. The variable temperature lawn chair device comprises a body component that is configured in the shape of a conventional lawn chair. The body component comprises a seating area, a backrest, and a plurality of legs. The seating area and backrest comprise a plurality of pockets which house refrigerated or frozen gel packs. The gel packs can be pre-cooled prior to being inserted into the multiple pockets on the chair device. The gel packs help keep the user cool without making the chair device uncomfortable to sit on. Further, the device also comprises a battery-powered heating element to provide warmth to the user. Thus, during cold weather, the heating element can be activated to elevate the chair device's temperature and keep the user warm. Accordingly, the chair device's temperature can be regulated to maintain comfort when sitting outdoors.

In this manner, the variable temperature lawn chair device of the present invention accomplishes all of the foregoing objectives and provides users with a device that can be warmed or cooled to maintain comfort when sitting outdoors. The device is a lawn chair with heating and cooling features. The device can be available in different colors and sizes.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a variable temperature lawn chair device. The device is a portable lawn chair with the ability to warm or cool its occupant. The variable temperature lawn chair device comprises a body component comprising a seating area, a backrest, and a plurality of legs. The seating area and backrest comprise a plurality of pockets which house refrigerated or frozen gel packs for cooling. Further, the device also comprises a battery-powered heating element to provide warmth to the user. Accordingly, the chair device's temperature can be regulated to maintain comfort when sitting outdoors.

In one embodiment, the variable temperature lawn chair device discloses a portable lawn chair having a heating and cooling means integral therewith. The variable temperature lawn chair device comprises a body component that is configured in the shape of a conventional lawn chair. Specifically, the body component comprises a seating area with a backrest vertically extending therefrom. The seating area is secured to a plurality of support legs that suspend the chair device above an underlying surface. Adjacent to each of the two sides of the seating area is an armrest. Preferably, the seating area, the backrest, and the support legs are collapsible in a conventional fashion.

In one embodiment, the body component comprises a frame having a pair of elongate front legs (i.e., support legs) in the form of poles, struts, or the like spaced apart by at least one cross-member also in the form of poles, struts, or the like. The cross-members could cross in front of each other or be in other configurations. The frame further includes a pair of elongate rear legs (i.e., support legs) also in the form of poles or the like spaced apart by at least one cross-member in the form of poles, struts, or the like. The cross-members can cross each other (as shown in the figures) or be in any configuration. The cross-members could be connected together and/or be attached to the front and rear legs by connectors or the like. Further, at least one cross-member extends between the front and rear legs, on each side of the seating area. In one embodiment, a side member extends between the backrest and the seating area. A side member could be positioned at each side of the backrest and extend out toward the front end of the seating area to form arm rests, which could be padded.

In one embodiment, the seating area could be of any material, such as canvas, plastics, hessian, cotton, or other suitable material as is known in the art. The seating area could be rigid or flexible. The seating area is connected to and perpendicular to a backrest. Both the seating area and the backrest have a front surface and a back surface. The back surface of the seating area can be attached to the rear and front legs by various fastening means, such as fabric pockets within which an end of the rear and front legs slide into, or by fastening straps attached to the frame. It should however be noted that various different fastening mechanisms could be utilized to secure the seat area and backrest on the frame.

In one embodiment, the seating area and/or the backrest comprise at least one pocket or pouch to provide temperature control to a region of the user when sitting in the chair device. The pocket can include a fastening means such as a zip, hook and loop fastener, or the like to close off a pocket opening, as needed. The pocket is adapted in use to receive a gel pack. The gel packs help keep the user cool without making the chair device uncomfortable to sit on. The pocket could also include a temperature-controlling lining, such as a cooling reflective material to radiate the cold generated by the gel packs. In one embodiment, the pocket or pouch could be releasably attachable to the chair device so that it can be used by a user away from the chair device. The gel pack is pre-cooled prior to being inserted into the pockets. Specifically, the gel packs are pre-cooled via refrigeration or freezing (i.e., placed in a refrigerator or freezer), or placed in ice, or the like to assist with temperature regulation.

In one embodiment, the seating area and the backrest comprise a heating element and power switch secured to a back surface of the seating area and/or the backrest. The heating element preferably would be removable from the chair device and replaceable depending upon the needs of the user. The heating element could also be placed in various different positions in various different locations on the chair device, as required. The heating element would be fitted ergonomically into the chair device such as below a cushioned portion or the like. The heating element would utilize a power supply, such as batteries, and/or comprise various charge ports for use with a car charge cord or an electrical cord. Accordingly, an energy source, such as batteries, an electrical charging port, or a car charging port are in communication with the heating element. The energy source provides energy to the heating element. Specifically, the heating element receives energy from the energy source and converts that energy to heat which heats the chair device. The heating element also has a charging cord that can be connected to a wall outlet, a car charging port, or other power sources, to power the heating element through its charging ports.

In one embodiment, the chair device could also include a lumbar support cushion, a headrest cushion, etc., These cushions can be integrally formed with the chair device and comprise both a pocket for the gel packs and are in direct communication with the heating element, such that direct heating and cooling can be targeted to a specific area of a user sitting on the chair device.

In one embodiment, instead of a battery-powered heating element, a hot pack can be inserted into the pockets. The hot packs can be pre-heated via a microwave or other suitable heating means. In one embodiment, the hot packs are vacuumed sealed and when opened to the air, an exothermic chemical reaction occurs, causing the hot packs to give off heat. Further, the pockets can comprise an insulated heat reflective material to radiate heat generated by the hot packs.

In one embodiment, the pockets can comprise temperature packs that can be either heated and/or cooled for use. In this embodiment, separate hot and cold packs are not utilized and instead, a single temperature pack can be both cooled or heated, as needed.

In one embodiment, the chair device could be a stool without the backrest, or virtually any type of conventional indoor or outdoor chair or seat having either a seating area, a backrest, or both. The size, shape, color, and materials of construction of the variable temperature lawn chair device can also be varied, per a user's needs and/or wants.

In yet another embodiment, the variable temperature lawn chair device comprises a plurality of indicia.

In yet another embodiment, a method of heating or cooling a lawn chair is disclosed. The method includes the steps of providing a variable temperature lawn chair device comprising a body component comprising a seating area and a backrest with a plurality of pockets. The method also comprises inserting at least one pre-cooled gel pack into each of the plurality of pockets to cool the chair device. Further, the method comprises activating the heating element to elevate the chair device's temperature. Finally, the method comprises regulating the chair device's temperature to maintain comfort when sitting outdoors.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
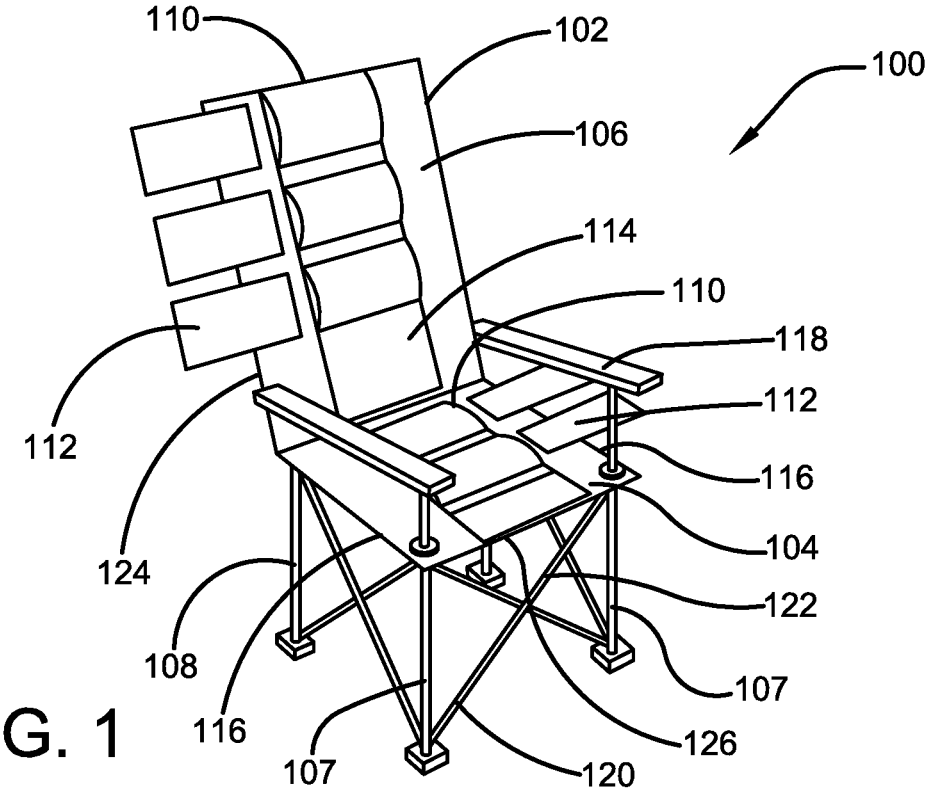
FIG. 1 illustrates a perspective view of one embodiment of the variable temperature lawn chair device of the present invention showing the device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a variable temperature lawn chair device that provides users with a lawn chair that can be warmed or cooled to maintain comfort when sitting outdoors. There is also a long-felt need in the art for a variable temperature lawn chair device that includes multiple pockets along the backrest and seating area on the chair that can receive refrigerated or frozen gel packs for keeping the user cool. Further, there is a long-felt need in the art for a variable temperature lawn chair device that features an integrated battery-powered heating mechanism to warm the chair during cold weather. Moreover, there is a long-felt need in the art for a device that allows users to regulate the chair's temperature based on weather to maintain optimal comfort while outdoors at campsites, tailgates, sporting events, etc. Further, there is a long-felt need in the art for a variable temperature lawn chair device that utilizes pre-cooled gel packs to cool the chair. Finally, there is a long-felt need in the art for a variable temperature lawn chair device that is available in different colors and sizes.

The present invention, in one exemplary embodiment, is a novel variable temperature lawn chair device. The variable temperature lawn chair device comprises a body component that comprises a seating area, a backrest, and a plurality of legs. The seating area and backrest comprise a plurality of pockets which house refrigerated or frozen gel packs. The gel packs help keep the user cool without making the chair device uncomfortable to sit on. Further, the device also comprises a battery-powered heating element to provide warmth to the user. Thus, during cold weather, the heating element can be activated to elevate the chair device's temperature and keep the user warm. Accordingly, the chair device's temperature can be regulated to maintain comfort when sitting outdoors. The present invention also includes a novel method of heating or cooling a lawn chair. The method includes the steps of providing a variable temperature lawn chair device comprising a body component comprising a seating area and a backrest with a plurality of pockets. The method also comprises inserting at least one pre-cooled gel pack into each of the plurality of pockets to cool the chair device. Further, the method comprises activating the heating element to elevate the chair device's temperature. Finally, the method comprises regulating the chair device's temperature to maintain comfort when sitting outdoors.

Referring initially to the drawings, FIG. 1 illustrates a perspective view of one embodiment of the variable temperature lawn chair device 100 of the present invention. In the present embodiment, the variable temperature lawn chair device 100 is an improved variable temperature lawn chair device 100 that provides a user with a portable lawn chair with the ability to warm or cool its occupant. Specifically, the variable temperature lawn chair device 100 comprises a body component 102 with a seating area 104, a backrest 106, and a plurality of legs 107 and 108. The seating area 104 and backrest 106 comprise a plurality of pockets 110 which house refrigerated or frozen gel packs 112 for cooling. Further, the device 100 also comprises a battery-powered heating element 114 to provide warmth to the user. Accordingly, the chair device's temperature can be regulated to maintain comfort when sitting outdoors.

Generally, the variable temperature lawn chair device 100 discloses a portable lawn chair having a heating and cooling means integral therewith. The variable temperature lawn chair device 100 comprises a body component 102 that is configured in the shape of a conventional lawn chair. Specifically, the body component 102 comprises a seating area 104 with a backrest 106 vertically extending therefrom. The seating area 104 is secured to a plurality of support legs 107 and 108 that suspend the chair device 100 above an underlying surface. Adjacent to each of the two sides 116 of the seating area 104 is an armrest 118. Preferably, the seating area 104, the backrest 106, and the support legs 107 and 108 are collapsible in a conventional fashion.

Furthermore, the body component 102 comprises a frame 120 having a pair of elongate front legs 107 (i.e., support legs) in the form of poles, struts, or the like spaced apart by at least one cross-member 122 also in the form of poles, struts or the like. The cross-members 122 could cross in front of each other or be in other configurations. The frame 120 further includes a pair of elongate rear legs 108 (i.e., support legs) also in the form of poles or the like spaced apart by at least one cross-member 122 in the form of poles, struts, or the like. The cross-members 122 can cross each other (as shown in the figures) or be in any configuration. The cross-members 122 could be connected together and/or be attached to the front 107 and rear 108 legs by connectors or the like. Further, at least one cross-member 122 extends between the front 107 and rear 108 legs, on each side of the seating area 104. In one embodiment, a side member (i.e., armrest 118) extends between the backrest 106 and the seating area 104. A side member 118 could be positioned at each side 124 of the backrest 106 and extends out toward the front end 126 of the seating area 104 to form arm rests 118, which could be padded.

Additionally, the seating area 104 could be of any material, such as canvas, plastics, hessian, cotton, or other suitable material as is known in the art. The seating area 104 could be rigid or flexible. The seating area 104 is connected to and perpendicular to a backrest 106. Both the seating area 104 and the backrest 106 have a front surface 128 and a back surface 130. The back surface 130 of the seating area 104 can be attached to the rear 108 and front 107 legs by various fastening means, such as fabric pockets within which an end of the rear 108 and front 107 legs slide into, or by fastening straps attached to the frame 120. It should however be noted that various different fastening mechanisms could be utilized to secure the seating area 104 and backrest 106 on the frame 120.

Figure 2:
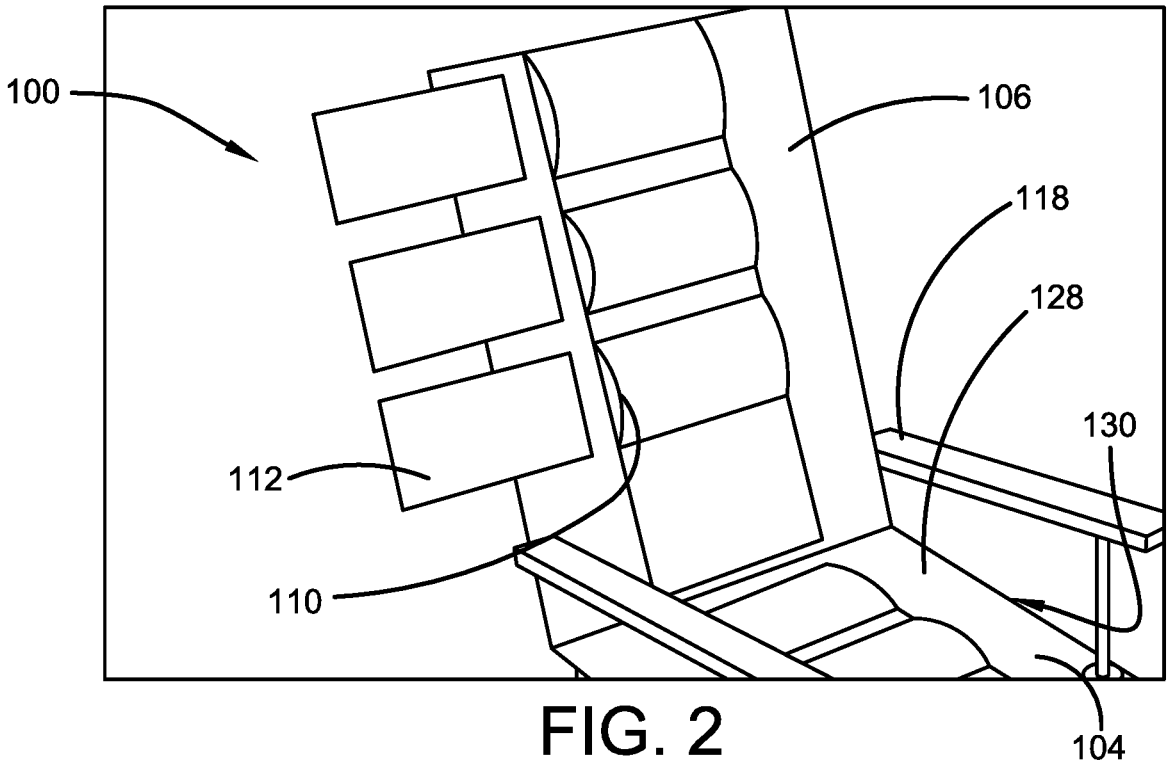
FIG. 2 illustrates a perspective view of one embodiment of the variable temperature lawn chair device of the present invention showing the pockets and gel packs on the backrest in accordance with the disclosed architecture.
Figure 3:
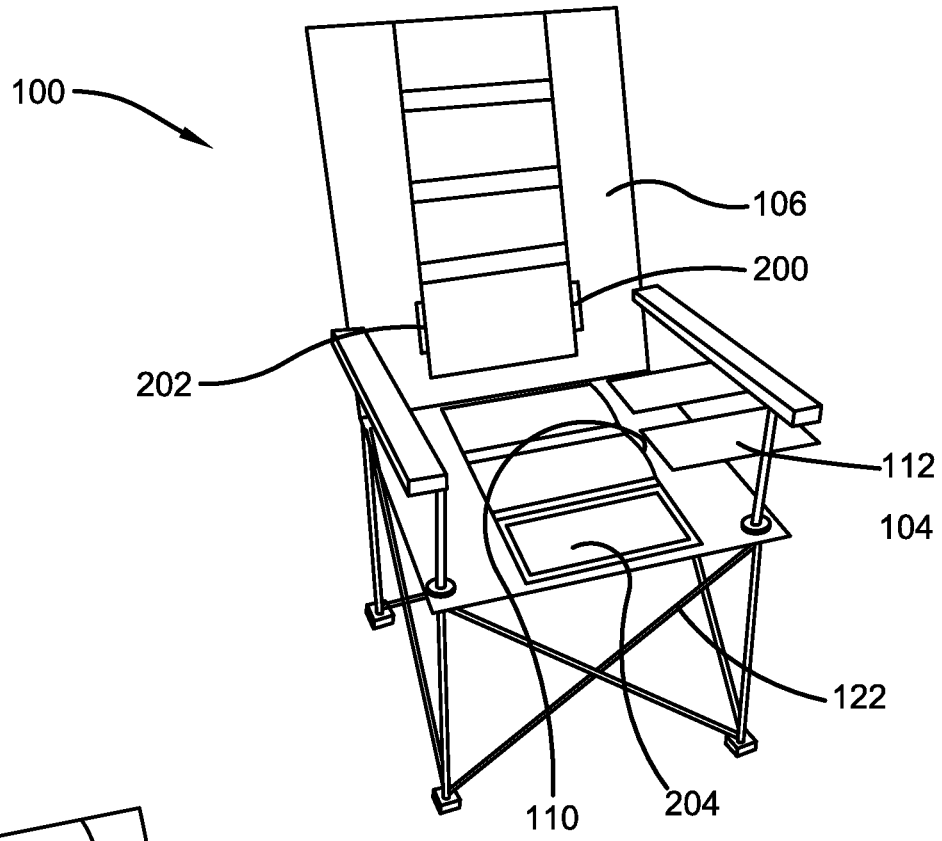
FIG. 3 illustrates a perspective view of one embodiment of the variable temperature lawn chair device of the present invention showing the pockets and gel packs on the seating area in accordance with the disclosed architecture.

As shown in FIGS. 2-3, the seating area 104 and/or the backrest 1106 comprise at least one pocket 110 or pouch to provide temperature control to a region of the user when sitting in the chair device 100. The pocket 110 can include a fastening means 200 such as a zip, hook and loop fastener, or the like to close off a pocket opening 202, as needed. The pocket 110 is adapted in use to receive a gel pack 112. The gel packs 112 help keep the user cool without making the chair device 100 uncomfortable to sit on. The pocket 110 could also include a temperature-controlling lining, such as a cooling reflective material 204 to radiate the cold generated by the gel packs 112. In one embodiment, the pocket 110 or pouch could be releasably attachable to the chair device 100 so that it can be used by a user away from the chair device 100. The gel pack 112 is pre-cooled prior to being inserted into the pockets 110. Specifically, the gel packs 112 are pre-cooled via refrigeration or freezing (i.e., placed in a refrigerator or freezer), or placed in ice, or the like to assist with temperature regulation.

Figure 4:
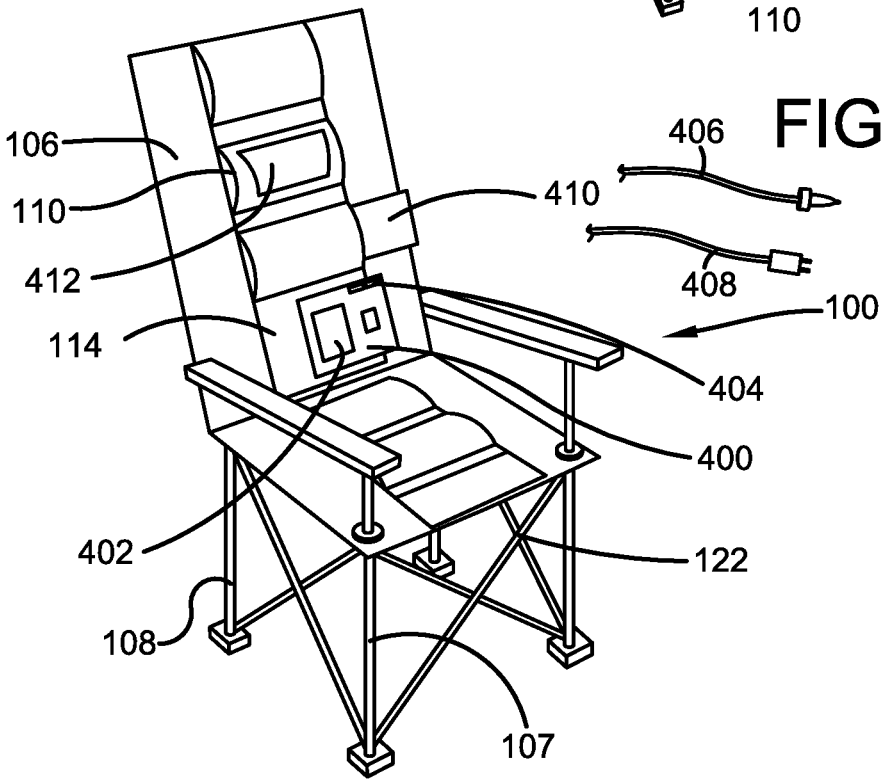
FIG. 4 illustrates a perspective view of one embodiment of the variable temperature lawn chair device of the present invention showing the heating element of the device in accordance with the disclosed architecture.

As shown in FIG. 4, the seating area 104 and the backrest 106 comprise a heating element 114 and power switch 400 secured to a back surface 130 of the seating area 104 and/or the backrest 106. The heating element 114 preferably would be removable from the chair device 100 and replaceable depending upon the needs of the user. The heating element 114 could also be placed in various different positions in various different locations on the chair device 100, as required. The heating element 114 would be fitted ergonomically into the chair device 100 such as below a cushioned portion or the like. The heating element 114 would utilize a power supply, such as batteries 402 and/or comprise various charge ports 404 for use with a car charge cord 406 or an electrical cord 408. Accordingly, an energy source, such as batteries 402 or an electrical charging port 404, or a car charging port 404 are in communication with the heating element 114. The energy source provides energy to the heating element 114. Specifically, the heating element 114 receives energy from the energy source and converts that energy to heat which heats the chair device 100. The heating element 114 also has a charging cord 406 and 408 that can be connected to a wall outlet, a car charging port, or other power source, to power the heating element 114 through its charging ports 404.

In one embodiment, instead of a battery-powered heating element 114, a hot pack 410 can be inserted into the pockets 110. The hot packs 410 can be pre-heated via a microwave or other suitable heating means. In one embodiment, the hot packs 410 are vacuumed sealed and when opened to the air, an exothermic chemical reaction occurs, causing the hot packs 410 to give off heat. Further, the pockets 110 can comprise an insulated heat reflective material 412 to radiate heat generated by the hot packs 410.

Figure 5:
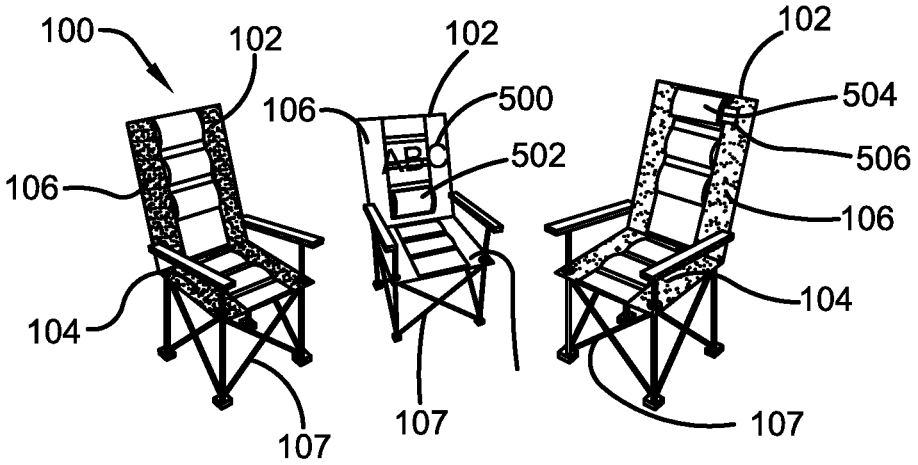
FIG. 5 illustrates a perspective view of one embodiment of the variable temperature lawn chair device of the present invention showing the chair device available in different colors and sizes in accordance with the disclosed architecture.

As shown in FIG. 5, the chair device 100 could also include a lumbar support cushion 502, a headrest cushion 504, etc., These cushions 502 and 504 can be integrally formed with the chair device 100 and comprise both a pocket 110 for the gel packs 112 and are in direct communication with the heating element 114, such that direct heating and cooling can be targeted to a specific area of a user sitting on the chair device 100.

In one embodiment, the pockets 110 can comprise temperature packs 506 that can be either heated and/or cooled for use. In this embodiment, separate hot 410 and cold 112 packs are not utilized and instead, a single temperature pack 506 can be both cooled or heated, as needed.

In another embodiment, the chair device 100 could be a stool without the backrest 106, or virtually any type of conventional indoor or outdoor chair or seat having either a seating area 104, a backrest 106, or both. The size, shape, color, and materials of construction of the variable temperature lawn chair device 100 can also be varied, per a user's needs and/or wants.

In yet another embodiment, the variable temperature lawn chair device 100 comprises a plurality of indicia 500. The body component 102 of the device 100 may include advertising, a trademark, or other letters, designs, or characters, printed, painted, stamped, or integrated into the body component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be lawn chair, hot or cold, or brand related.

Figure 6:
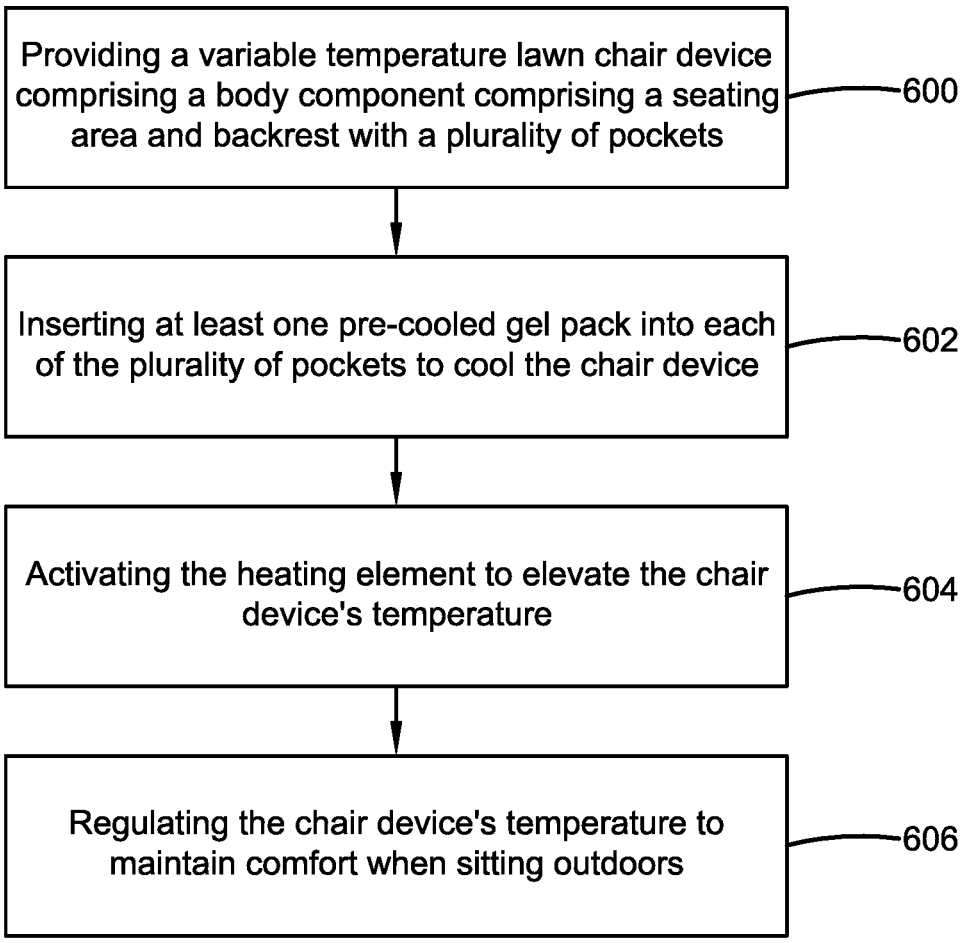
FIG. 6 illustrates a flowchart showing the method of heating or cooling a lawn chair in accordance with the disclosed architecture.

FIG. 6 illustrates a flowchart of the method of heating or cooling a lawn chair. The method includes the steps of at 600, providing a variable temperature lawn chair device comprising a body component comprising a seating area and backrest with a plurality of pockets. The method also comprises at 602, inserting at least one pre-cooled gel pack into each of the plurality of pockets to cool the chair device. Further, the method comprises at 604, activating the heating element to elevate the chair device's temperature. Finally, the method comprises at 606, regulating the chair device's temperature to maintain comfort when sitting outdoors.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "variable temperature lawn chair device", "lawn chair device", "chair device", and "device" are interchangeable and refer to the variable temperature lawn chair device 100 of the present invention.

Notwithstanding the foregoing, the variable temperature lawn chair device 100 of the present invention can be of any suitable size and configuration as is known in the art without affecting the overall concept of the invention, provided that it accomplishes the above-stated objectives. One of ordinary skill in the art will appreciate that the variable temperature lawn chair device 100 as shown in FIGS. 1-6 is for illustrative purposes only, and that many other sizes and shapes of the variable temperature lawn chair device 100 are well within the scope of the present disclosure. Although the dimensions of the variable temperature lawn chair device 100 are important design parameters for user convenience, the variable temperature lawn chair device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A variable temperature lawn chair device that provides a user with a portable lawn chair with the ability to warm or cool its occupant, the variable temperature lawn chair device comprising:

a body component configured in shape of a conventional lawn chair;

a plurality of legs secured to the body component; and a plurality of pockets each comprising a fastening means;

wherein the body component comprises a seating area with a backrest vertically extending therefrom;

wherein the seating area, the backrest and the plurality of legs are collapsible in a conventional fashion;

wherein an armrest extends between the backrest and the seating area;

wherein the seating area and the backrest comprise the plurality of pockets for retaining pre-cooled gel packs;

wherein the gel packs are pre-cooled via refrigeration or freezing;

wherein the seating area and the backrest comprise a heating element;

wherein the heating element is powered by batteries;

wherein the heating element is powered by charge ports for use with a car charge cord or an electrical cord;

wherein the body component comprises a frame having a pair of elongate front legs spaced apart by at least one cross-member, a pair of elongate rear legs spaced apart by at least one cross-member, and at least one cross-member extending between the pair of elongate front legs and the pair of elongate rear legs on each side of the seating area;

wherein the lumbar support cushion and the headrest cushion comprise both a pocket for the gel packs and are in direct communication with the heating element, such that direct heating and cooling can be targeted to a specific area of a user sitting on the body component; and further wherein the pre-cooled gel packs and the heating element act to regulate temperature of the body component to maintain a user's comfort when sitting outdoors.

2. The variable temperature lawn chair device of claim 1, wherein the body component comprises a lumbar support cushion and a headrest cushion.

3. The variable temperature lawn chair device of claim 1, wherein the plurality of pockets can comprise temperature packs that can be either heated or cooled for use.

4. The variable temperature lawn chair device of claim 1, wherein the body component can be manufactured in different sizes and colors.

5. The variable temperature lawn chair device of claim 1 further comprising a plurality of indicia.

* * * * *